United States Patent [19]

Arnone

[11] Patent Number: 4,924,801

[45] Date of Patent: May 15, 1990

[54] SPRAY BOOTH FOR LACQUER

[76] Inventor: Joseph A. Arnone, 258 Briggs St., Syracuse, N.Y. 13208

[21] Appl. No.: 371,605

[22] Filed: Jun. 26, 1989

[51] Int. Cl.[5] ..... B05C 11/00

[52] U.S. Cl. ..... 118/58; 118/301; 118/323; 118/326; 118/500; 118/DIG. 7; 98/115.2

[58] Field of Search ..... 118/326, 301, 323, 58, 118/500, DIG. 7; 98/115.2

[56] References Cited

U.S. PATENT DOCUMENTS 2,106,187 1/1938 Nausler ..... 118/326

3,663,270 5/1972 Blair ..... 118/DIG. 7

*Primary Examiner*—Bernard Nozick

*Attorney, Agent, or Firm*—Wall and Roehrig

[57] ABSTRACT

A spray booth for coating photographs with lacquer has a hooded work area exhausted through a filter to capture overspray and solvents. A perforated work holding platen is provided together with a pre-heating and drying air supply to minimize blushing of the lacquer coat. The spray gun is a low pressure heated system that is track-mounted for uniform coating by unskilled operators.

19 Claims, 3 Drawing Sheets

SPRAY BOOTH FOR LACQUER

BACKGROUND OF THE INVENTION

This invention relates to spray booths for spraying a coating of flammable or toxic volatile material on an object and capturing substantially all of the overspray and volatile components of the material being sprayed in an exhaust system which conveys the contaminated air to a suitable decontamination/discharge system.

In many industries and in the photographic industry in particular, it is desirable to have a finish coating of lacquer applied to photographs or other objects to seal and protect the object from being soiled in normal usage. This is particularly important in high-quality photographs where a seal or hardener/protector is needed to insure that a photograph will last over an extended period of time in an undamaged condition.

As the awareness of environmental problems associated with highly volatile and toxic materials has become a major consideration in recent years, the practice of spraying volatile material such as lacquer coatings has required the provision of systems to capture the overspray and volatile components of the material such as lacquer and associated solvents and remove them from the area in which workers are present. In the photographic industry it used to be standard practice to lay photographs to be sprayed on a table and spray the whole table in an open room. Sometimes the operator wore a mask, but basically, no effort was made to properly remove the overspray and volatile components of the lacquer as the product dried in the open air.

OBJECTS AND SUMMARY OF THE INVENTION

Accordingly, it is an object of the present invention to provide a spray booth for spraying photographs with clear lacquer in a safe and environmentally correct system.

It is another object of the present invention to provide a spray booth for spraying photographs with lacquer which captures overspray and other volatile components of the sprayed material as it is sprayed onto the photographs, and carries them away from the operator of the booth for discharge to a proper exhaust treatment system exterior of the spray booth.

It is yet another object of the present invention to provide a simplified, easy-to-maintain system for capturing overspray and volatile components during the spraying operation of a spray booth.

It is a further object of the present invention to provide a system for spraying photographs with clear lacquer that includes a spray booth for removing overspray and volatile components of the lacquer during the spraying operation, as well as simplified spraying means for insuring uniformity of quality and ease of operation.

It is yet a further object of the present invention to provide a system for spraying clear lacquer on photographs that includes a complete combination of spraying means, air heating means, humidity control means, and spray booth means for capturing the volatile elements and the overspray from the spraying operation and discharging it to proper treatment facilities.

It is a still further object of the present invention to provide a spray booth that can be quickly and easily serviced and maintained by untrained personnel in an economical fashion.

It is another object of the present invention to provide a spray booth having modular elements for capturing the overspray, for holding the picture to be sprayed in proper position for spraying, and a low air pressure spraying system for reducing overspray to the bare minimum, all while still meeting the necessary quality of application of the lacquer to the photograph.

It is an even further object of the present invention to provide a spray booth that is economical to construct and operate for spraying lacquer on photographs such that a wide variety of photographic facilities can fully meet the environmental requirements for spraying toxic and flammable materials.

These and other and further objects of the invention, together with their advantages will become apparent from the following description of a preferred embodiment of the invention, which is shown in the accompanying drawings, wherein:

DETAILED DESCRIPTION OF A PREFERRED EMBODIMENT

Figure 1:
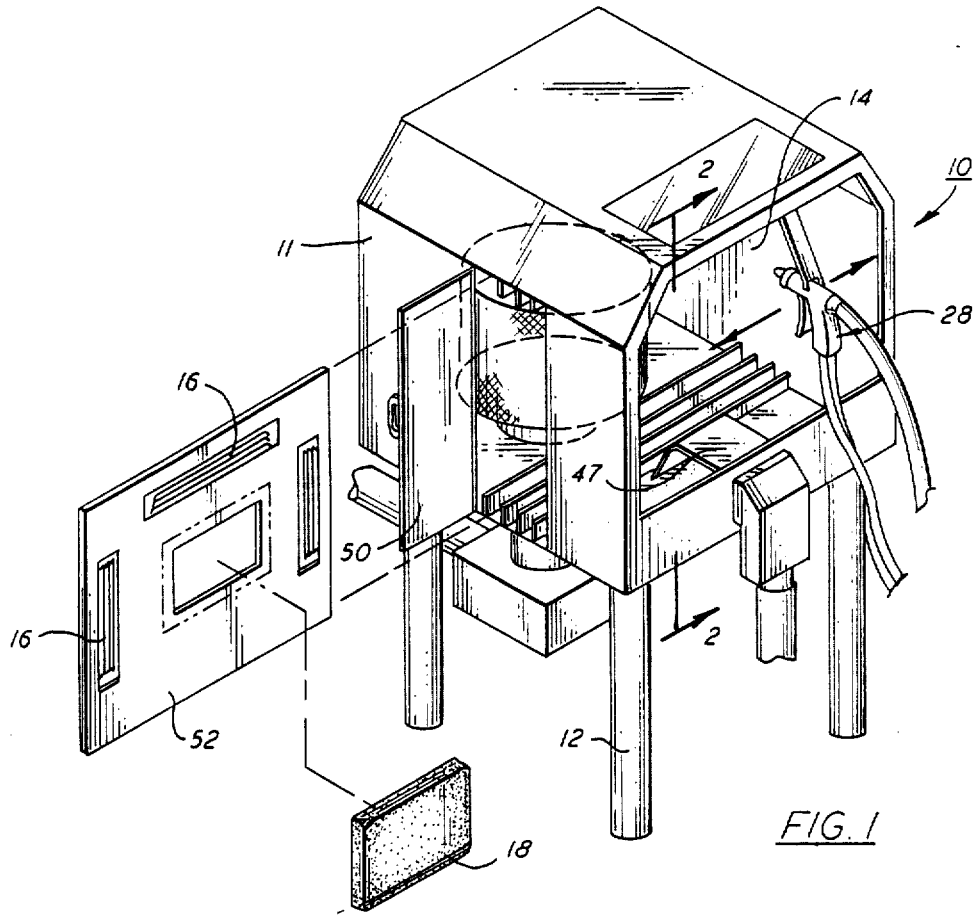
FIG. 1 is a perspective of a spray booth according to the present invention.
Figure 3:
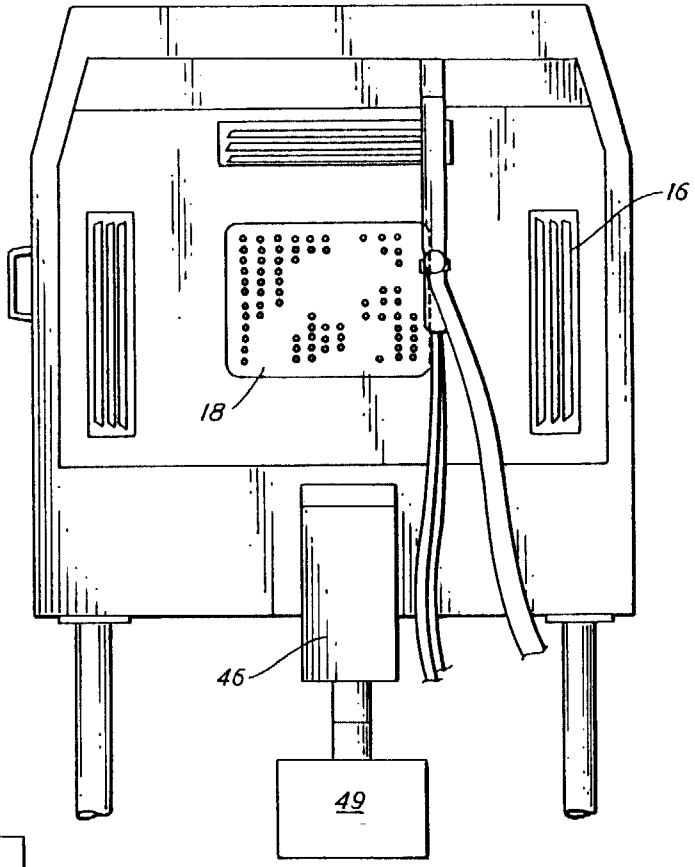
FIG. 3 is a front elevation of the spray booth of the present invention.
Figure 2:
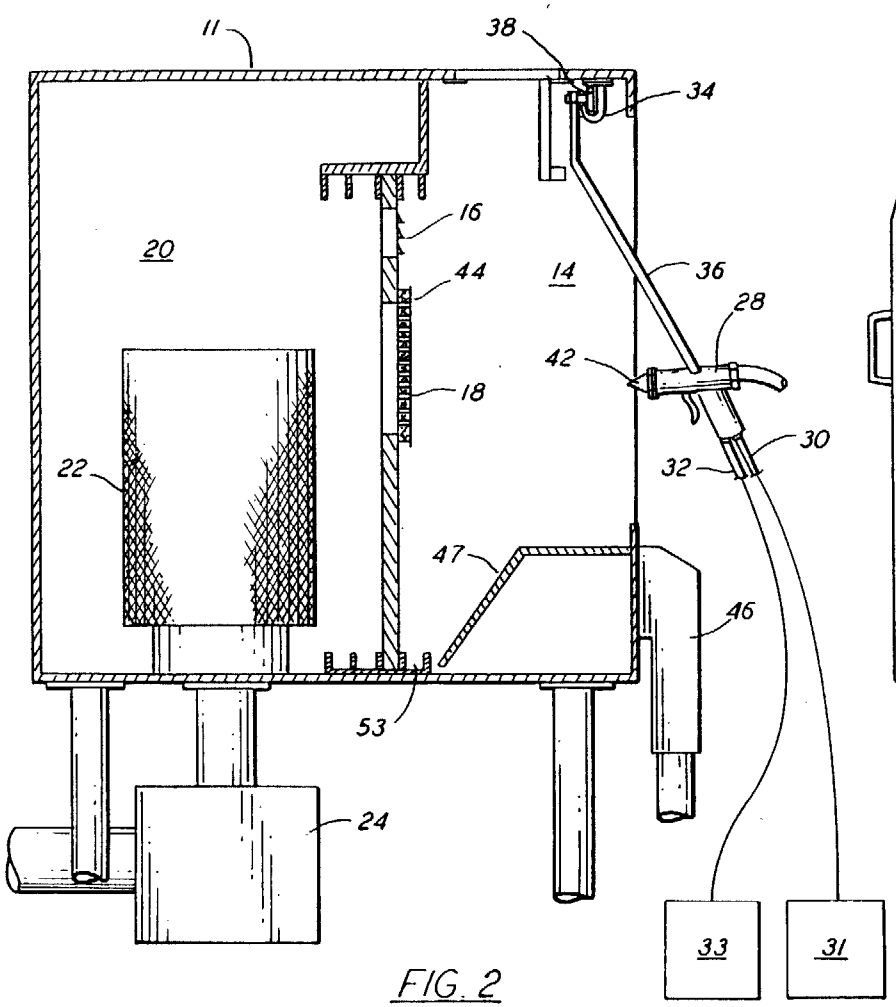
FIG. 2 is a side elevation of the spray booth of the present invention.

As may be seen in FIGS. 1-3, the spray booth 10 comprises a rectangular compartment or housing 11 mounted on suitable legs 12 with a large open side forming a shrouded work area 14. A partition or divider plate 52 is positioned in housing 11 to form a closed compartment 20 and the shrouded open work area 14 within the housing. Partition 52 has four vents 16 located about the periphery of the work surface area and a photograph vacuum mounting platen 18 which is adapted to receive thereon the photograph to be sprayed, disposed in the center. Each of the vents 16 and the vacuum platen 18 are in open communication with the rear chamber 20 in the overall housing 11. Positioned in chamber 20 is a filter 22 which is connected to an exhaust blower 24. Blower 24 exhausts air from the front work area 14 through the partition vents, through the filter and through the blower to an exhaust system where the discharged air flow will be treated in accordance with current environmental and safety requirements. The blower 24 may be operated by any convenient electrical motor (not shown), although preferably it will be an explosion-proof motor to meet the necessary flammability and explosion safety requirements for facilities of this type.

A suitable light, not shown, that will meet the aforementioned safety requirements is mounted at the upper front face of the open work area 14 of the spray booth to properly light the mounting platen 18 where the photograph to be sprayed will be placed.

As part of the spray booth system according to the present invention, there is provided a special spray gun 28 which is a low pressure, high volume type of spray gun which has an air hose 30 and a lacquer hose 32 connected to the bottom of the handle portion thereof and has the usual spray nozzle, with electric heater if desired, for effecting the proper pattern at the work to be sprayed. A suitable lacquer pot 33 and low pressure air compressor 31 are connected thereto by the respective hoses. This spray gun is mounted on a track 34 in the upper front part of the spray booth work face by a bracket 36 which has a roller 38 in its upper extremity such that the spray gun can be moved from side-to-side when looking at the front of the machine, as in FIG. 3. This results in a steady, smooth spraying motion across the face of the photograph by even inexperienced personnel. A stop bar 40 is provided to adjustably set the distance from the spray nozzle 42 to the photograph to be sprayed 44. As is well known in the art, for a particular viscosity of the lacquer and air pressure there is an optimum distance for the spray pattern. The distance and position of gun 28 can be pre-adjusted and set so the unskilled operator can perform a professional job.

One of the problems encountered, as is well known in the art, in spraying lacquer is "blushing" of the finished coating when the humidity becomes excessive. Generally speaking, a relative humidity of fifty percent or less will cause no problems with blushing of the lacquer on the finished product. Above seventy or eighty percent, there is always a problem of blushing. In between it will depend upon specific circumstances of the moment.

In order to again make the system as fool-proof as possible, and to allow an inexperienced operator to be proficient in lacquer coating photographs, a source of hot air is provided at the bottom front of the spray booth work area 14, as shown at 46. This is shown in perspective form in FIG. 1 and comprises the duct 46, connected to a source of heated air 49, usually from a hot air dryer, and a deflector-diffuser 47, positioned so that warm air blown from this duct 46 will be directed generally toward the back of the booth, and will at least partially flow over the photograph 44 to be sprayed. Ideally, the air supplied through this vent will be in the neighborhood of one hundred eighty to two hundred degrees Fahrenheit with a relative humidity of less than fifty percent. In one embodiment of the present invention, we have found that air supplied by a dryer used in conjunction with the spray booth, and as disclosed in our co-pending application filed concurrently herewith, meets this requirement very nicely. In that case, we take the exhaust air from the dryer apparatus and duct it to the input of the work area in the spray booth and find that it helps insure high-quality work while at the same time allowing a single discharge of all the air that has the volatile solvents entrained in it, to suitable processing and recovery facilities, all the while maintaining a safe working environment around the machines.

A special feature of the present invention is the modular building block approach that has been followed throughout in designing this spray booth for not only precision application of the coating of lacquer, but for ease of cleaning and maintenance. As may be seen in FIG. 2, there is provided on the side a door 50 which gives access to the interior of the compartment 20. Mounted in channels 53 within the compartment 20 are one or more vent plates 52 which have the edges formed at right angles to the plate itself to stiffen and provide support for locating the plate between the work area 14 and the exhaust area 20 in channels 53 (See FIGS.1 and 2).

With door 50 open and the divider plate 52 removed, easy access is provided to compartment 20 for cleaning the interior of the compartment 20. Particles of dried lacquer, dust or other particles can thus be easily and quickly removed to insure safe and proper operation of the spray booth.

The partitions 52 carry on them in an easily removable fashion, the vent or louver members 16, and the photograph mounting platen 18. For ease of maintenance and operation, the complete plate 52 may be removed with its associated vents and photograph mounting plate which have become encrusted with overspray and other elements of the lacquer and a clean, fresh plate installed so that operation of the spray booth can be continued without interruption. The filter 22 is provided in compartment 20 to remove dust particles, solidified lacquer particles, and so forth from the air stream before discharging the air to the exhaust processing facility, (not shown), exterior of the machine.

As may be seen in FIG. 1, the plate 52 has detachably mounted thereon the louvers 16 and the vacuum platen 18. These are held on the plate 52 in a preferred embodiment by small magnets positioned in the corners thereof so that they can be quickly and easily removed for cleaning and servicing.

In operation the spray booth is activated by turning on the blower 24, low pressure air for the gun 28 and the heating element for the nozzle 42, if desired. As is known in the industry, it is desirable in some applications to heat the lacquer as it leaves the gun so that it will evaporate and set more quickly and uniformly on the picture. Once the systems are warmed up and ready to go, a photograph is positioned on the platen 18 and held there by the vacuum effect of the exhaust passing through holes 19 in platen 18. The spray gun 28 is moved smoothly and uniformly from right to left or left to right as the operator desires in one or two passes as necessary to apply the proper thickness of lacquer film on the photograph.

With the exhaust blower operating, there is developed a sufficient negative air pressure and air flow in the work area 14 of the spray booth so that the overspray from the gun 28, is sucked in through the louvers 16 into the exhaust system within chamber 20 instead of bouncing back out into the operator's face.

Figure 4:
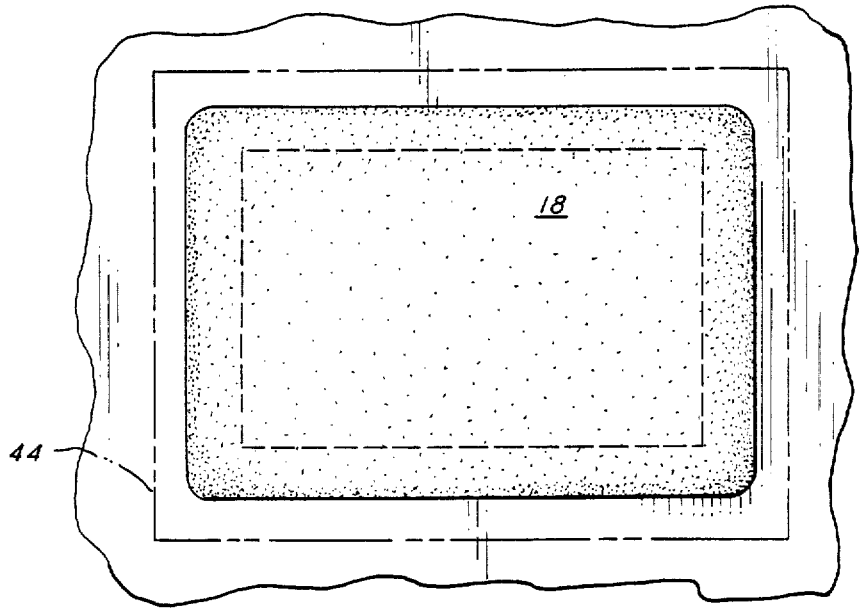
FIG. 4 is a front elevation of the photo positioning platen of the present invention.

As may be seen in FIG. 4, this negative pressure also allows the small holes in the platen 18 to securely hold the photograph 44 in the proper position for applying the lacquer coat. Preferably, platen 18 is slightly smaller than the photograph 44 so no lacquer directly hits the platen. The "suction" is not so great as to cause problems in removing the wet paper. The wet photograph can be easily and simply lifted off the platen and placed on an adjacent dryer for drying in proper fashion so as to capture the volatile solvents and flammable portions that might otherwise escape into the room and become a safety hazard for the operator. As mentioned above, our co-pending application describes a suitable drying apparatus for accomplishing this function.

The spray gun 28 is presented to the photograph to be sprayed in a smooth, uniformly spaced fashion by rolling it along the track 34 with brackets 36 sliding along the bar 40. A layer of lacquer is therefore applied to the photograph in a uniform, equally distributed fashion so as to thoroughly cover it, but not to overspray it causing runs or other imperfections.

Figure 5:
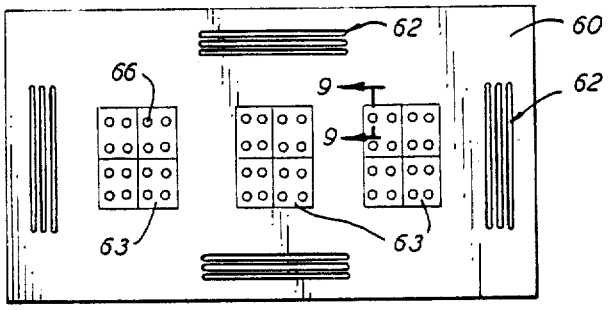
FIG. 5 is a front elevation showing another embodiment of a divider vent plate.
Figure 6:
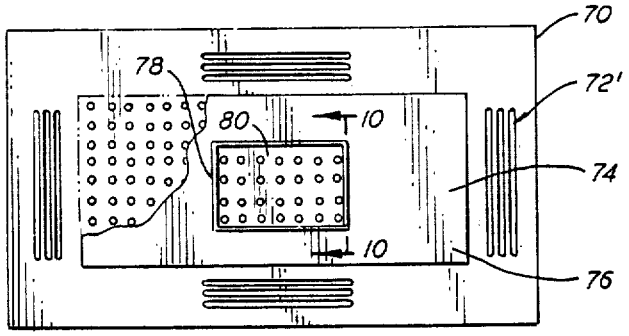
FIG. 6 is a still further embodiment of the divider vent plate shown in FIG. 1.
Figure 10:
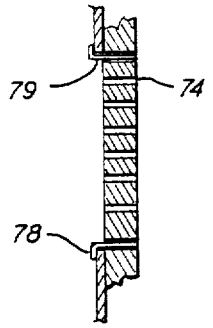
FIG. 10 is a partial sectional view of the collar member holding the cardboard mask in place in FIG. 6.
Figure 7:
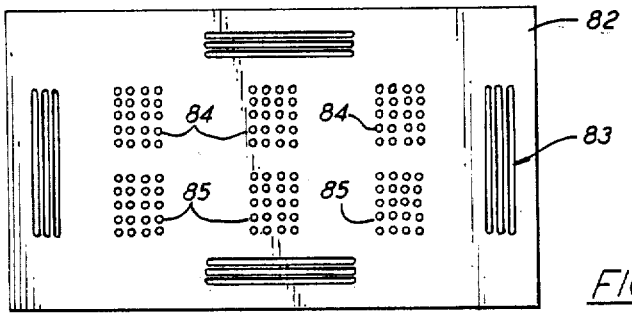
FIG. 7 is a still further embodiment of a divider vent plate suitable for use in the present invention.

Referring now to FIGS. 5–7 there is shown alternative embodiments of divider plates 52 for use in the present spray booth. To provide flexibility in operation of the device and to permit spraying of various types and sizes of pictures, a series of different dividers may be provided, each adapted to suit a particular size photograph or sequence of photographs, depending upon the specific application of the user.

Figure 9:
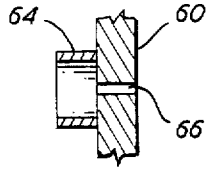
FIG. 9 is a partial sectional view of one of the standoffs of FIG. 5.

In FIG. 5, a divider 60 is shown which is made out of a solid sheet of polypropylene approximately one-quarter of an inch thick, and sized to fit within the slots 53 of FIG. 1. Divider 60 has peripheral slots 62, preferably three each, disposed along the sides of the divider 60. Slots 62 are about one-quarter inch wide and are spaced apart about one-half inch. These provide the necessary ventilation for removing the overspray and volatile components of the lacquer being applied to the photographs that are mounted in the work area 63 of the partition 60. As shown in FIG. 5, there are three picture mounting work areas 63 for holding various size pictures. A series of 16 small diameter holes 66 are provided in each area. Each area 63 has sixteen small sections of pipe 64, as shown in FIG. 9, welded or glued to the plate 60 about the holes 66. These are disposed about the mounting area 63 to form a standoff vacuum platen area that will hold a photograph in spaced relation from the partition 60 so that excess spray may drip off or overspray will not unduly build up and adhere the photograph to the divider 60. These small pieces of tubular plastic 64, approximately one-half inch in diameter and one-half inch long, form a simple yet very effective method for holding photographs to be sprayed when the air system is in operation. Three of these units are provided in a typical divider. The operator, by positioning various size photographs on the platens 62 and by blocking off any remaining with baffles, can spray a variety of different size pictures in the usual fashion as described herein.

In FIG. 6 another divider 70 is provided which has vent slots 72 similar to slots 62 in FIG. 5, and a series of small holes 74 drilled therein throughout the work surface of the divider. The exhaust fan will draw air through each one of the little holes providing a vacuum holding system when a covering is placed over them. As shown in FIG. 6, a throw-away cardboard mask 76 is provided which has a cutout in the center for the appropriate size photograph that it is desired to spray. Mask 76 is held in place on the divider 70 when the fan is on by vacuum, but since it is not desirable to have to place the mask on the divider every time the air is turned on and off, there is provided a picture frame or rectangular collar 78 which has pegs 79 on it to be inserted into one or two of the holes 74 to hold the cardboard in place even when the air is turned off. A variety of cardboard members 76 can be provided to accommodate various sizes and shapes of photographs to be sprayed. After a number of layers of lacquer have built up, they can be disposed of in the usual fashion. The photograph to be sprayed is held in the opening 80 of the mask 76 by the vacuum drawn through the small holes 74 exposed therein.

Referring now to FIG. 7 there is shown another embodiment of a divider plate 82 for the spray booth of FIG. 1. This divider similarly is made of a plastic material such as polypropylene. In the embodiments of FIGS. 5–7 polypropylene is chosen because the lacquer does not adhere to it and the buildup of lacquer overspray can be readily peeled off periodically to clean the device and to prevent dangerous build up of flammable materials. Divider 80 has the usual slots 83 for removing the overspray into the inner chamber 20 of the device of FIGS. 1 and 2 and has two rows of three apertures each for mounting photographs thereon. Each aperture area has a series of holes drilled therein and small tubing standoffs such as shown in FIG. 9 welded or glued about the hole to form a vacuum platen. Typically, in each picture mounting area 84 and 85 there are sixteen standoffs to hold photographs up to $8 \times 10$ size in proper position for lacquer coating. The divider of FIG. 7 slides into the slots 53 (FIG. 1) just as the other dividers do, but it is particularly suited for use in connection with an automatic spraying system as will be described and shown in connection with FIG. 8 herein. The upper row of apertures 84 are generally positioned in a line as are the lower apertures 85 in a lower spaced apart line so that when the spray gun is adjusted properly and passed over the apertures 84, the overspray does not materially effect the photographs positioned in the apertures 85. Conversely, when the spray gun is passed across the row of apertures 85, overspray does not fall on the apertures 84 to any appreciable extent.

Figure 8:
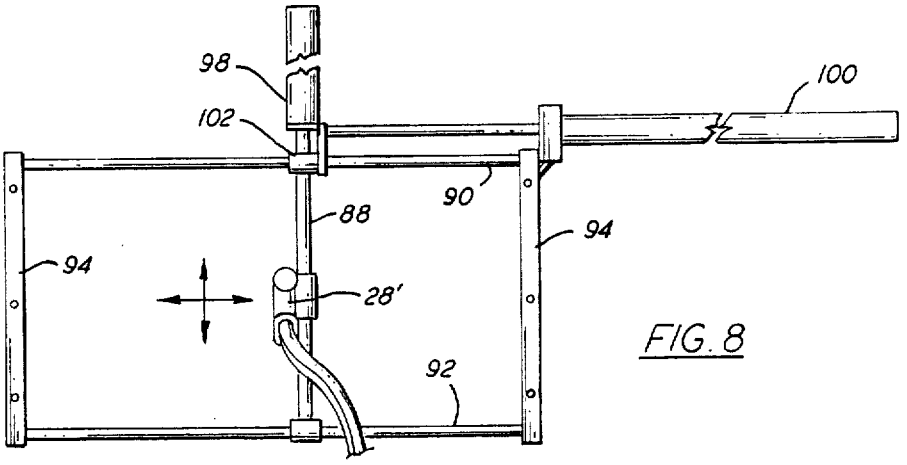
FIG. 8 is a schematic partial front elevation of an automatic spraying system for the spray gun of the present invention as applied to the spray booth of FIG. 1.

Referring now to FIG. 8, there is shown a semi-automatic version of the device shown in FIGS. 1–4. In this configuration, the spray gun 28' is mounted for vertical movement up and down a rod 88 which is slidably mounted on guide rods 90 and 92 for transverse movement back and forth across the mouth of the spray booth 10. The bars 90 and 92 are spaced apart by frame members 94 and detachably mounted on the face of the spray booth 10. The assembly replaces the spray gun 28, shown in FIGS. 1 and 2. The frame 94 carries, in addition to the guide bars 90 and 92, a fluid cylinder 100 generally air operated. Cylinder 100 is connected to bracket 102 slidably mounted on bar 90 to carry the bar 88 back and forth across the face of the spray booth. Bracket 102 also carries the cylinder 98, again air operated, which is adapted to position the spray gun 28' in an upper position for spraying an upper row of pictures mounted on the apertures 84 of divider 82 or in a lower position to properly apply lacquer to photographs mounted on the lower apertures 85 on divider 82. As air pressure is applied to cylinder 100, the vertical bar carrying the spray gun 28' is moved from left to right and right to left across the face of the spray booth 10.

With the addition of a simple control, not shown, the spray gun will move transversely from the upper position on the left hand side of FIG. 8 to the upper right hand position. Cylinder 98 will then lower gun 28' down rod 88 to the lower position on the right hand side and cylinder 100 will return gun 28' across the face of the spray booth to the lower left hand position and thence back to the point of beginning. As the spray gun passes over the pictures mounted on the apertures 84 and 85 suitable lacquer coating will be applied as described in connection with the embodiment of FIGS. 1–3. Thus, after manually mounting the photographs to be sprayed on the divider of FIG. 7, the spraying operation can be automatically fulfilled by this simplified pneumatic control system for the transport of the spray gun past the photographs to be coated.

It can thus be seen that we have provided a very efficient, easily maintained, economical to own and operate photograph spraying facility that will meet all presently known safety and environmental requirements.

While the invention has been described in the specification, and illustrated in the drawings, with reference to the preferred embodiment, it will be understood by those skilled in the art that various changes may be made and equivalent substituted without departing from the scope of the claims herein.

What is claimed is:

1. A paint spray booth for spraying volatile and flammable materials on an object comprising:

an enclosure member;

a frame member for supporting said enclosure at a convenient operating height from the floor;

an open side in said enclosure;

a dividing partition in said enclosure forming an enclosed compartment and an open compartment adjacent said open side;

exhaust blower means connected to the enclosed compartment formed by said dividing partition within said enclosure;

a plurality of ventilation louver means releasably mounted on said dividing partition and defining a passageway therethrough;

a vacuum platen member having a plurality of small holes therein releasably mounted at the center of said dividing partition and defining further passageways therethrough;

a low pressure pneumatic spray gun for spraying lacquer material slidably mounted in the open side of said enclosure for transverse movement back and forth across said opening;

lacquer supply means and low pressure air supply means operatively connected to said spray gun; and control means for activating said blower means so that a negative air pressure is applied across the open side of said enclosure to draw air through said open compartment and into said enclosed compartment to capture the overspray from the spray gun, and the volatile components from the sprayed lacquer for exhaust out of the apparatus through the exhaust blower and to hold photographs to be sprayed on said platen means.

2. A device as described in claim 1 wherein said spray gun is spaced a predetermined distance from the photograph to be sprayed so that a uniform layer of lacquer is applied to the photograph automatically as the spray gun is passed across the face of the enclosure and activated.

3. A device as described in claim 1 further defined by auxiliary air input means mounted at the edge of said enclosure open side, including an air duct; a source of air; means for heating said air attached to said air input duct; and air deflecting means positioned to direct air flowing from said duct means toward said platen member.

4. A lacquer spraying apparatus of the type adapted to apply a clear protective coating to a photograph while capturing and containing the overspray and volatile components of the lacquer being sprayed which comprises:

a generally rectangular housing having one open side, mounted on a frame to support said housing at a convenient operating height;

an inner filter compartment;

an exhaust blower connected to said filter compartment for exhausting air therefrom;

a partition member removably mounted between said inner filter compartment and said open side;

photograph positioning means mounted on said partition member;

vent means disposed in said partition around said photograph positioning means; and spray gun means slidably mounted at a predetermined distance from said photograph mounting means for back-and-forth movement parallel to the surface of the photograph to be sprayed at said predetermined distance therefrom.

5. A lacquer spraying system as described in claim 4 wherein said partition member is spaced inwardly from the open side of the enclosure so as to form a shroud about the photograph mounting means upon which the photograph to be sprayed is mounted; and said spray gun means is disposed within said shroud area so that any excess spray and any volatile components of the lacquer being sprayed will be captured by the air flow through said shroud area to said exhaust blower.

6. A device as described in claim 4 wherein said partition member has cut therein a plurality of openings; said photograph positioning means has a plurality of small diameter holes drilled therein and is mounted over one of said plurality of openings at the center of said partition member; and said vent means are removably mounted over the remaining openings.

7. A device as described in claim 4 further characterized by auxiliary make-up air means mounted on an input edge of said shroud area, including a source of temperature and humidity modified air and baffle means for directing said auxiliary make-up air over the photograph to be sprayed so that the photograph is maintained in the proper low humidity, warmed condition for best reception of the lacquer material to be sprayed thereon.

8. A device as described in claim 4 wherein said housing includes a door in one side thereof, at least one pair of top and bottom mounting channels disposed in said housing for slidably receiving therein said partition means so that said partition can be quickly and easily removed for cleaning.

9. A device as described in claim 4 wherein said photograph positioning means comprises a rectangular box cover portion; a plurality of small diameter holes drilled in said cover portion; at least one magnet mounted in said cover portion for securing it to said partition means about an opening therein so that when a photograph is placed on said cover portion it will be held in place by said exhaust blower.

10. A lacquer spraying apparatus as described in claim 4 wherein said partition member comprises a panel of plastic having a series of vent slots disposed around the periphery thereof and a plurality of photograph mounting platen areas with multiple small holes therein in direct communication with said inner compartment.

11. The device of claim 10 wherein said panel is formed of polypropylene to facilitate removal of dried lacquer therefrom.

12. The device of claim 10 wherein said platen areas comprise a series of small holes drilled in said plastic panel, and a corresponding tubular standoff secured to said panel about each hole in said platen area.

13. The device of claim 12 wherein each platen area has sixteen holes and tubular standoff members.

14. The device of claim 13 wherein said platen areas are disposed in a horizontal row of three separate platen and standoff areas.

15. A lacquer spraying apparatus as described in claim 4 wherein said partition member comprises a panel of plastic having a series of vent slots disposed around the periphery thereof;

a plurality of small diameter holes drilled in said partition member throughout substantially the entire work surface area thereof;

at least one disposable mask member disposed over said work surface area and having a predetermined opening therein, of a size suitable to receive therein a photograph to be sprayed.

16. The device of claim 15 further defined by a collar having the same shape as the opening in said mask, mounted on said panel through said opening to hold said mask in position when the exhaust air is inoperative.

17. The device of claim 16 further defined by said collar having a flange adapted to overlap the surface of the mask adjacent said opening and at least one mounting pin disposed in one of said plurality of small diameter holes in said partition.

18. A lacquer spraying apparatus as described in claim 4 wherein said spray gun means comprises at least one horizontal and one vertical guide bar positioned on said housing open side; one of said bars being slidably mounted on the other; a spray gun slidably mounted on said slidably mounted bar so that said spray gun can be automatically moved about a rectangular path within said housing while spraying photographs mounted on said partition member.

19. A lacquer spraying apparatus as described in claim 18 wherein said spray gun means further includes a rectangular frame member, an upper and lower horizontal guide bar, a vertical slide bar slidably mounted on said horizontal bars, horizontal and vertical air cylinders for selectively moving said spray gun along said guide bars and control means for causing said spray gun to move in a rectangular reciprocal pattern within said housing open side.

* * * * *